United States Patent [19]

Collins, Jr.

[11] Patent Number: 4,967,188

[45] Date of Patent: Oct. 30, 1990

[54] METHOD FOR DETECTING LOW BATTERY VOLTAGE IN PORTABLE SCANNING SYSTEMS

[75] Inventor: Donald A. Collins, Jr., Ithaca, N.Y.

[73] Assignee: NCR Corporation, Dayton, Ohio

[21] Appl. No.: 387,195

[22] Filed: Jul. 26, 1989

[51] Int. Cl.[5] ..... G08B 21/00

[52] U.S. Cl. ..... 340/636; 235/462

[58] Field of Search ..... 340/636, 648; 235/462, 235/472, 467; 324/160; 388/806, 815, 821, 822; 318/66, 461, 463

[56] References Cited

U.S. PATENT DOCUMENTS

| | | | |
|---|---|---|---|
| 3,181,030 | 4/1965 | Weinstein | 317/9 |
| 3,386,006 | 5/1968 | Runge | 317/31 |
| 3,629,679 | 12/1971 | Halfhill | 318/563 |
| 3,778,696 | 12/1973 | Walters et al. | 318/565 |
| 4,453,117 | 6/1984 | Elms et al. | 318/778 |
| 4,679,154 | 7/1987 | Blanford | 235/462 |
| 4,722,020 | 1/1988 | Nomura et al. | 361/31 |
| 4,763,054 | 8/1988 | Bundy | 318/301 |

*Primary Examiner*—Joseph A. Orsino
*Assistant Examiner*—Jeffery A. Hofsass
*Attorney, Agent, or Firm*—Wilbert Hawk, Jr.; Stephen F. Jewett; Gregory P. Gadson

[57] ABSTRACT

A method for detecting low battery voltage in a hand-held scanner capable of reading the likes of a bar code measures the speed of the motor driving the scanning element and compares it to stored values. The stored values represent motor speeds directly corresponding to maximum and minimum battery voltages. The stored values can be introduced to the scanner for example, at the factory. If the motor speed is found to be lower than the speed corresponding to the minimum acceptable battery voltage, user understandable message is produced, which necessitates either battery re-charging or replacement.

17 Claims, 5 Drawing Sheets

METHOD FOR DETECTING LOW BATTERY VOLTAGE IN PORTABLE SCANNING SYSTEMS

BACKGROUND OF THE INVENTION

The present invention generally relates to scanning systems capable of reading bar codes. More particularly, the present invention provides a safety feature for detecting low battery voltage.

Some scanning systems of the laser (light amplification by stimulated emission of radiation) type focus a laser beam upon a motor driven, rotating or dithering scanning mirror such that the laser beam forms a scanning pattern across a target bar code. The scanning laser beam is back-reflected to a photodetector, which determines the intensity of the back-reflected laser beam and outputs a current in proportion thereto. Thus a varying signal is output by the photodetector as the laser beam sweeps across a pattern of light and dark "bars" in a bar code.

Control circuitry controls the cooperation and coordination of the components (including the timing) and converts the photodetector output signal into useful form. Scanning speed is chiefly controlled by the speed of the motor.

It is important in prior art scanning systems that the power output of the power supply be kept at an acceptable level so that the scanning system can properly function. Battery power supplies are especially susceptible to depletion and thus power output reduction. Thus, it is desirable to monitor the battery power output, and indicate an unacceptably low output to the scanning system user, so that the battery may be replaced, for example.

SUMMARY OF THE INVENTION

It is an object of the present invention to provide a laser scanning system wherein low battery voltage is automatically and efficiently detected.

It is another object of the present invention to implement such an automatic low battery detection feature using existing motor drive and control circuitry.

It is yet another object of the present invention to share the same microprocessor for scanning circuitry control, motor control (including commutation logic for a brushless motor), and automatic low battery voltage level indication.

A further object of the present invention is to implement the above objects in a hand-held unit.

There is provided in accordance with the present invention, a method of detecting battery voltages in a battery-powered scanning system capable of reading the likes of a bar code. The present invention includes the steps of moving a scanning element by a motor connected thereto, producing a laser beam for focus upon and deflection by the scanning element, the laser beam thus being able to scan the likes of a bar code, driving the motor and outputting signals from sensors connected to the motor corresponding to scanning element movement, storing a minimum battery voltage and a corresponding motor speed in memory, during operation of the scanning system, measuring the motor speed and comparing it to the motor speed corresponding to the minimum battery voltage, and producing a user perceivable signal indicating unacceptably low battery voltage when the measured motor speed is below the motor speed the minimum battery voltage (for appropriately reversing the magnetic fields to "pull" the armature around its axis), varying signals (commutation logic) are applied to the appropriate windings to cause the magnetic fields to constantly change. The commutation logic is microprocessor controlled. A portable battery included in the housing of the scanner powers the motor as well as the control circuitry.

A three-phase motor is used instead of a single-phase motor since it provides for constant instantaneous power, and therefore a constant speed—an important feature for scanning operations.

It is important that the battery output voltage be at least equal to a minimum level so that the scanner can properly and efficiently operate.

The above and other objects, features, and advantages of the present invention will become apparent from the following description with reference to the attached drawings.

DETAILED DESCRIPTION OF THE INVENTION

Figure 1:
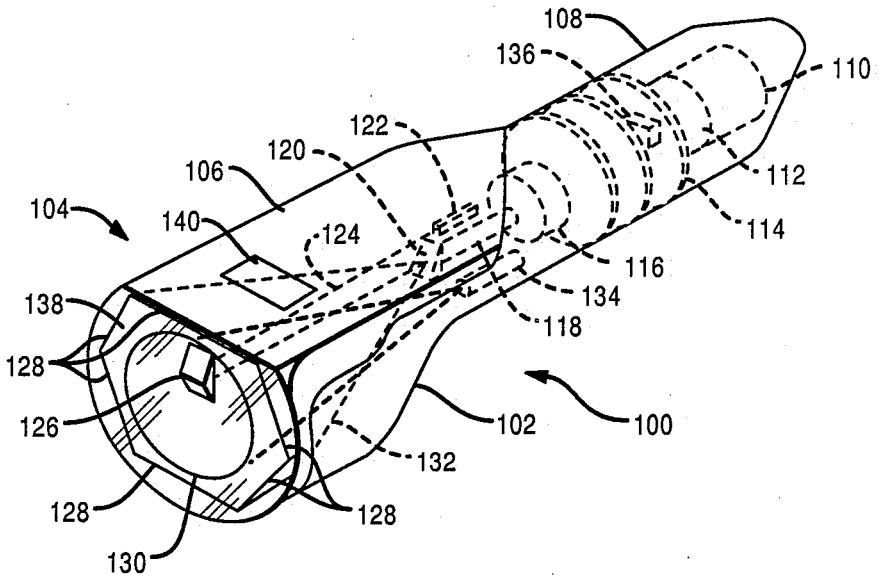
FIG. 1 is a perspective view, with certain internal, hidden details shown in phantom, of a hand-held laser scanner capable of incorporating the present invention.
Figure 2:
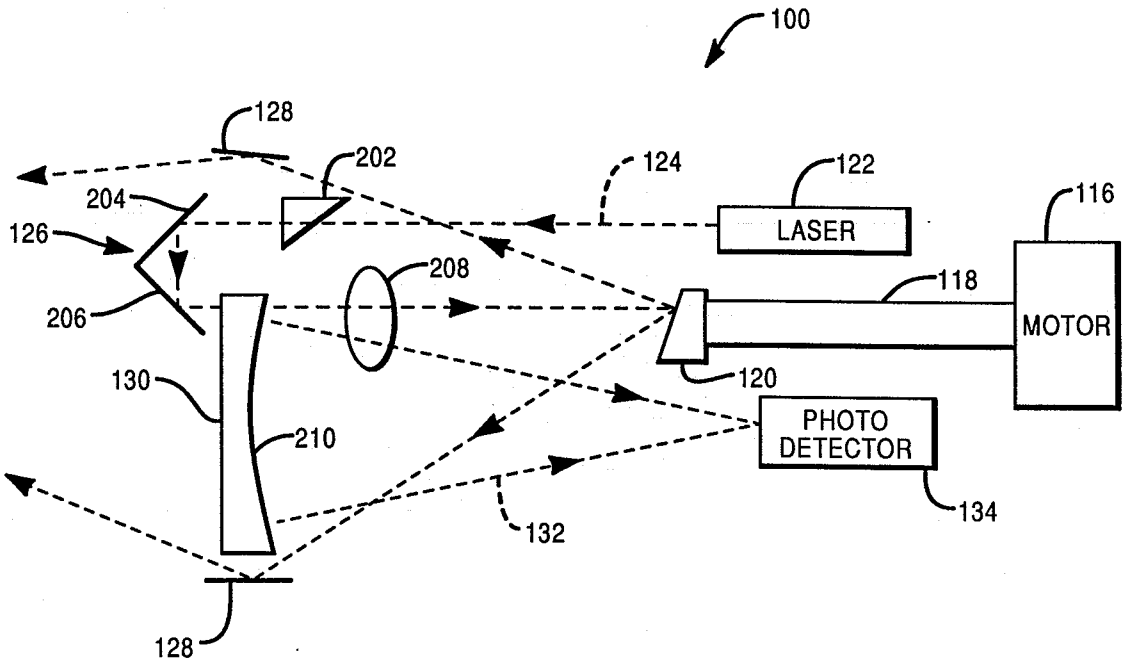
FIG. 2 is a schematic diagram of the scanner in FIG. 1.

Referring now to FIGS. 1 and 2, a hand-held laser scanner 100 having a casing 102 and a front portion 104 is shown. The front, upper portion 106 of the casing 102 is a flat surface in the present embodiment, while the rear portion 108 of the casing 102 is in the form of a handle.

A power supply 110 supplies power to the components of the scanner 100 (while it is a battery in the preferred embodiment, a line power source is also possible). A radio transmitter 112 transmits radio signals to a receiver in a remote processing unit (not shown) indicative of a scanned bar code (not shown). The handle 108 also includes electrical rack members 114, and a motor 116 connected to a rotatable shaft 118, which motor and shaft rotate a scanning element 120 attached to the shaft 118 for altering the path of a laser beam. The scanning element is a mirror in the preferred embodiment.

A laser or laser diode member 122 emits a laser beam 124 which is back-reflected by a pair turning mirrors 126 which are arranged at an angle of 90° relative to each other. The rotating scanning element 120 reflects the laser beam received from the turning mirrors 126 toward six turning mirrors 128 located at the front portion 104 of the scanner 100. The turning mirrors 128 direct light derived from the laser 122 toward a bar code label (not shown) on a product to be scanned, for example.

A collection lens 130 collects and focuses A processing member 136 mounted on one of the electrical rack members 114 receives and converts the electrical signals output by the photodetector 134 into data used to address a look-up table in the remote processing unit. The data output by the processing member 136 is transmitted to the remote processing unit by the radio transmitter 112.

A user interface portion 140 contains a light-emitting-diode (LED) display, a liquid crystal display (LCD) and a speaker for audio-visually indicating to the user whether a current scan operation has been successful and, as will be described later, whether the battery is too low.

The scanning operation will now be examined more closely with reference to FIG. 2. The drive shaft 118 rotates the scanning element 120 via the motor 116. Light from the laser 122 along path 124 is circularized by an anamorphic prism 202, and then back-reflected by the turning mirrors 126 composed of turning mirrors 204 and 206. The light reflected from the turning mirror 126 is focused by a lens 208 onto the surface of the scanning element 120. The rotation of the scanning element 120 causes light to be reflected toward the turning mirrors 128. The light reflected from the turning mirrors 128 falls upon the target bar code label in the form of scan lines, as is well known in the art.

The light reflected from the bar code label is collected and transmitted to the photodetector 134 by the collection lens 130 which has a concave surface 210.

Figure 3:
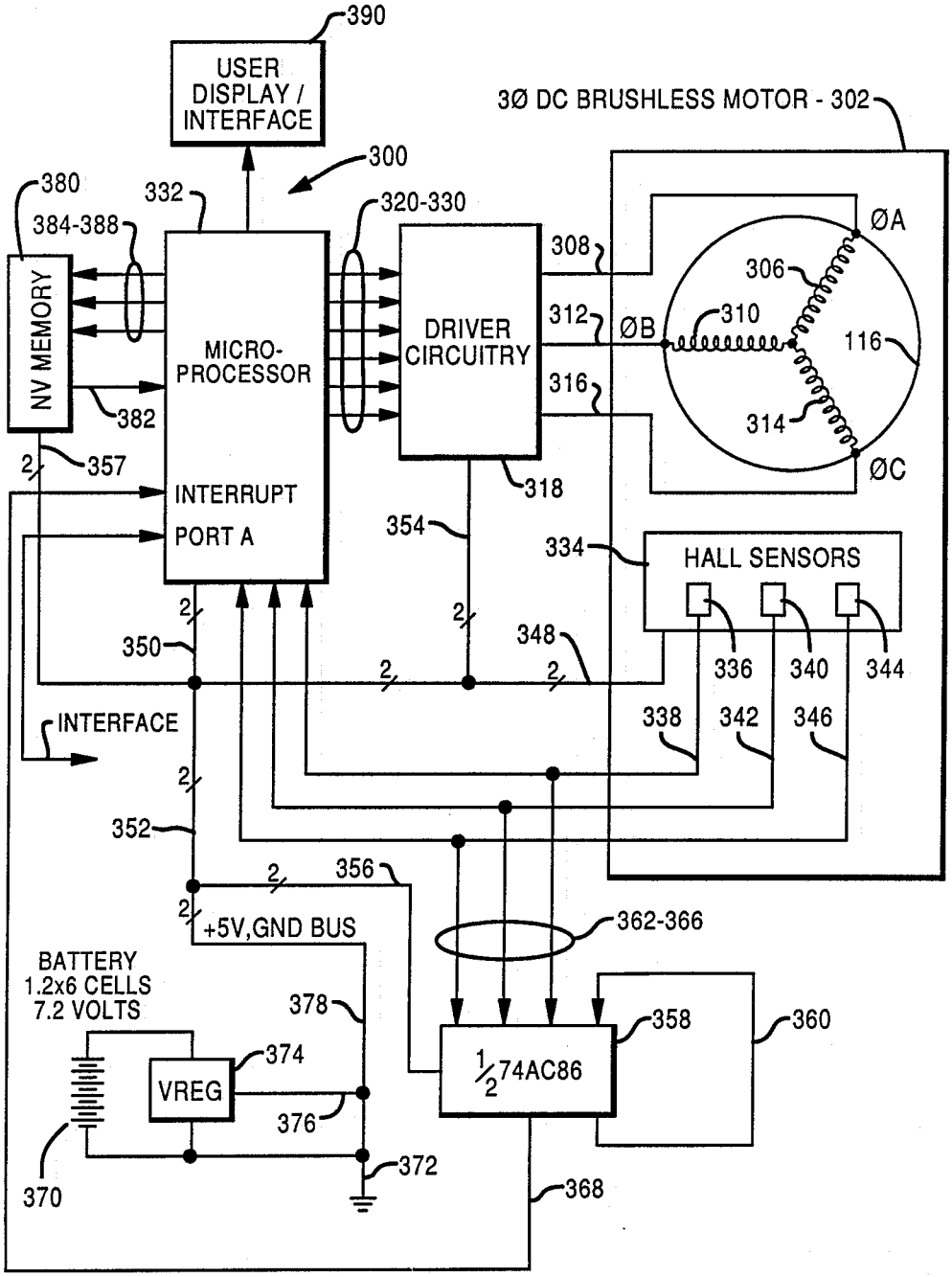
FIG. 3 is a schematic diagram of the control circuitry for the scanner motor and low battery voltage detection.

The microprocessor, as conventional, has an interrupt input (INTERRUPT) and a communications port (PORT A). As conventional, the INTERRUPT input is used to initiate a motor drive routine, and the PORT A input is used with an input/output interface to instruct the microprocessor during factory calibration of the system. Turning to FIG. 3, control for the commutation logic is shown. A motor and sensor unit 302 contains the three-phase, brushless DC motor 116 which has three sets of equispaced armature coils 306, 310 and 314 connected by lead lines 308, 312 and 316, respectively. The lead lines 308, 312 and 316 are connected to driver circuitry 318, which supplies the necessary voltages to the sets of armature coils 306, 310 and 314 for rotation of a four pole rotor (not shown) at a constant speed.

The bus driver 318 is connected by a group of control leads 320–330 to a microprocessor 332, which supplies the commutation logic necessary for motor operation. A Hall sensing unit 334 contains three Hall sensors 336, 340 and 344 spaced 60° apart from each other (i.e., Hall sensor 340 is spaced 50° from Hall sensor 335, and Hall sensor 344 is spaced 50° from Hall sensor 340), each connected to leads 338, 342 and 346, respectively. power and ground bus 352 which connects the components in FIG. 3 as shown, contains a 5 volt power line and a line connected to ground. A section 348 of the power and ground bus 352 supplies power to the Hall sensing unit, and sections 350, 354, 356 and 357 supply power to the other units as shown. The Hall sensors detect movement of the rotor and send signals evidencing the same to the microprocessor 332 and Exclusive Or (XOR) gate 358 (having one of its inputs tied to an output via line 360) via leads 362–366. The XOR gate 358 outputs an interrupt signal to the microprocessor 332 via line 368 when any of the Hall sensors sees a change in rotor position. Given the configuration of the rotor, and the positioning of the Hall sensors, the rotor movement is thus monitored every 30° of rotation.

A battery 370 for powering the system 300 has an output voltage of approximately 7.2 volts. The battery 370 is connected to ground at 372 and is in series with a voltage regulator 374, which outputs a voltage of approximately 5 volts on line 376, which connects the previously mentioned power and ground bus 352.

A non-volatile memory 380 stores a minimum motor speed and the corresponding battery voltage at the minimum speed from the microprocessor 332 via lines 384–388. In the preferred embodiment, the minimum values are programmed at the factory. During operation of the scanning system, a non-volatile memory output line 382 outputs the stored minimum motor speed value from the non-volatile memory 380 to the microprocessor 332 under its control when the battery voltage is to be estimated. Briefly, the stored minimum motor speed is periodically compared to the actual motor speed, as will be described later, with the difference in the actual and stored values being an indication of the available battery power above the minimum level. Likewise, a motor speed below the stored minimum speed indicates an unacceptably low battery voltage.

The existence of unacceptable battery voltages is communicated to the user via a user display/interface 390, which may be, for example, a combination of a liquid crystal display for displaying a video message and an audio transducer for producing an audible message such as a series of "beeps". The user display/interface 390 is included in the interface portion 140 referred to in connection with FIG. 1.

Figure 4:
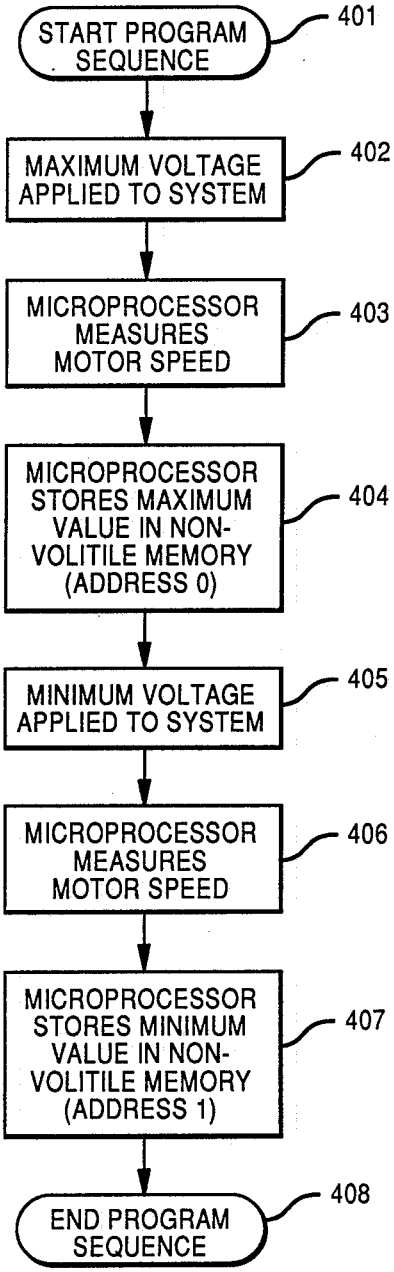
FIG. 4 is a flow chart diagramming the procedure for measuring and storing motor speeds and their corresponding battery voltages at the factory (before delivery to the user).

The flow chart in FIG. 4 generally illustrates the battery voltage-to-motor speed calibration process performed, for exmaple, at the factory. After power-up of the system the calibration program sequence is started (step 401). First the maximum acceptable battery voltage is applied to the system via bus 352 (step 402). At the factory, the microprocessor 332 is instructed via communications Port A to store the next measured motor speed in reference to the maximum acceptable voltage (step 403). The motor speed resulting from application of the maximum voltage is measured by the microprocessor 332 (via lines 338, 342 and 346) and then stored in the non-volatile memory 380 (step 404).

Then the minimum acceptable battery voltage is applied to the system via bus 352 (step 405). Also at the factory, the microprocessor 332 is instructed via communications Port A to store the next measured motor speed in reference to the minimum acceptable voltage. The corresponding motor speed is measured via lines 338, 342 and 346 (step 406) and is also stored in the non-volatile memory 380 (step 407). Thus, when the calibration program ends (step 408), the voltage and motor speed have been calibrated and stored for future use by the scanning system 300 during use by the user.

Figure 5:
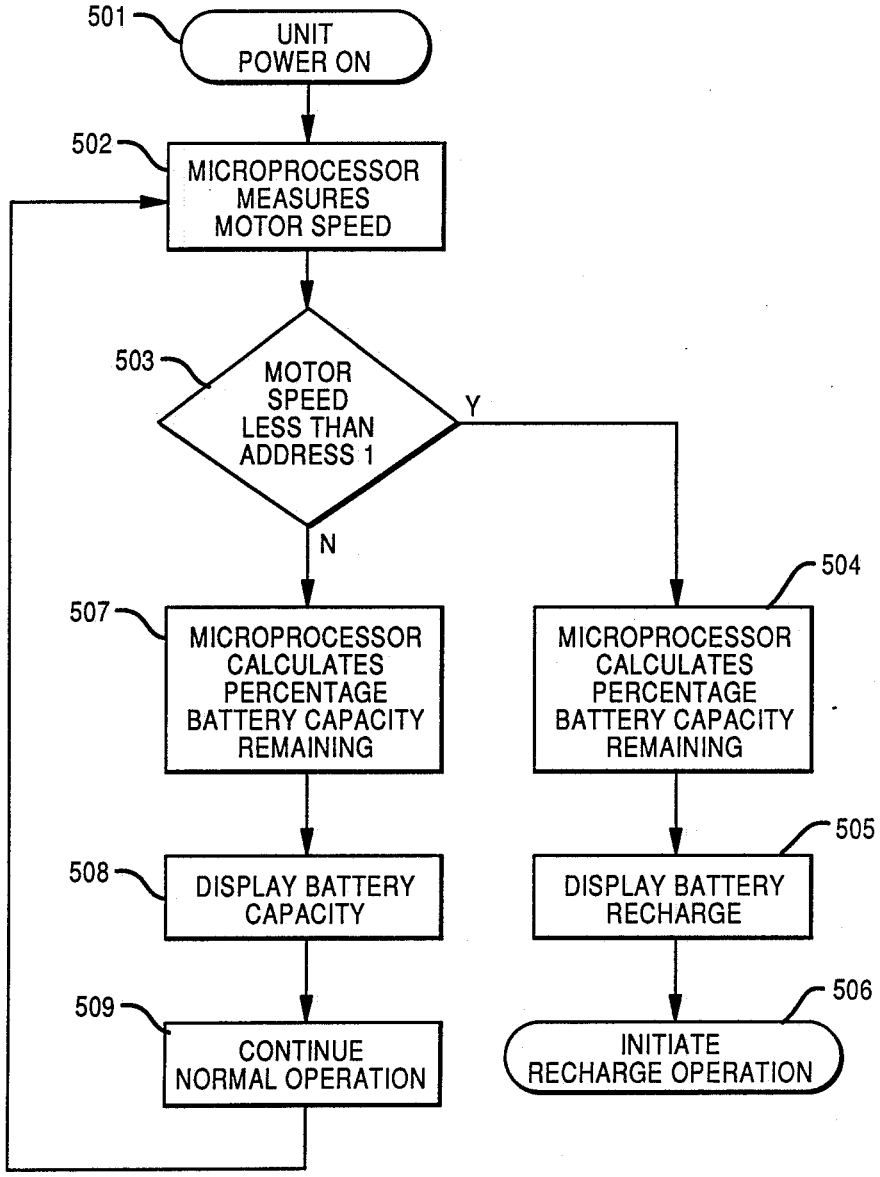
FIG. 5 is a flow chart diagramming the low battery detection operation by the scanning system while used by the user.

The flow chart in FIG. 5 outlines the procedure for low battery detection. The scanner is activated (step 501), and then the motor speed is measured (step 502). A decision is made (by comparing actual speed measurement values with factory-stored values in the memory 380) as to whether the motor speed is either less than the minimum stored speed (stored at address 1 in the working memory), or greater than or equal to the minimum stored speed (step 503). If the motor speed is greater than or equal to the minimum stored speed, the microprocessor 332 estimates a percentage of the battery capacity remaining before it becomes unacceptably low, using a stored algorithm (step 507). The algorithm may be conventional, and may include solving an experimentally-developed equation relating motor speed to battery capacity. The calculated battery capacity is displayed for the user (via display/interface 390) to give him an idea as to when the battery will need re-charging or replacement (step 508). From there, normal operation of the scanning system continues (step 509); i.e., the program returns to step 502.

If the measured motor speed is below the minimum stored value, the microprocessor 332 first calculates the percentage of the battery capacity remaining (step 504), and then causes a low battery voltage message to be communicated to the user via display/ interface 390 (step 505), which message indicates either re-charging or replacement of the battery. After the battery is recharged (step 506), the routine diagrammed in FIG. 5 is executed again to determine if the battery voltage is adequate. If the voltage is inadequate, a new battery can be substituted and tested in the same manner.

Variations and modifications to the present invention are possible given the above disclosure. However, variations and modifications which are obvious to those skilled in the art are intended to be within the scope of this letters patent. For example, in addition to monitoring motor speed to determine when the battery voltage is unacceptably low, the motor speed can be monitored to determine when the battery voltage is unacceptably high (such as with an overcharged or defective new battery) to warn the user of possible damage to the scanning system by high voltages. The stored maximum speed (step 404, FIG. 4) can be used to determine when the battery voltage is above an acceptable level.

I claim:

1. A method of detecting battery voltages in a battery-powered scanning system capable of reading a bar code comprising the steps of:

(a) moving a scanning element by a motor coupled thereto;

(b) producing a laser beam for focus upon and deflection by said scanning element, said laser beam thus being able to scan a bar code;

(c) driving said motor, and outputting signals from sensors coupled to said motor corresponding to scanning element movement;

(d) storing in memory, a value representing the motor speed which corresponds to a minimum battery voltage;

(e) during operation of the scanning system, measuring a motor speed derived from the signals output from said sensors and comparing it to the motor speed corresponding to said minimum battery voltage; and (f) producing a user perceivable signal indicating unacceptably low battery voltage when said measured motor speed is below the motor speed corresponding to said minimum battery voltage.

2. The method of detecting battery voltages in claim 1 further comprising the step of controlling steps (a) through (f) with a microprocessor.

3. The method of detecting battery voltages in claim 1 wherein said laser scanning system is of the hand-held type.

4. The method of detecting battery voltages in claim 1 wherein said scanning element is moved in a rotating manner.

5. The method of detecting battery voltages in claim 1 wherein said scanning element is moved in a dithering manner.

6. The method of detecting battery voltages in claim 1 wherein said scanning element is moved in either a rotating or dithering manner.

7. The method of detecting battery voltages in claim 1 further comprising the step of checking scanning element movement with said sensors every 30°.

8. The method of detecting battery voltages in claim 1 wherein said sensors are of the Hall type.

9. The method of detecting battery voltages in claim 1 wherein said motor is of the three-phase, DC type.

10. An apparatus for detecting battery voltages in a battery-powered scanning system capable of reading a bar code comprising:

scanning means for scanning a bar code;

a motor coupled to said scanning means for driving said scanning means;

motor drive circuitry for driving said motor;

memory for storing at least a value representing the motor speed corresponding to a minimum acceptable battery voltage;

means for comparing actual motor speeds with the stored motor speed; and means for producing a user perceivable signal indicating unacceptably low battery voltage when said actual motor speed is below said stored motor speed.

11. The apparatus in claim 10 further comprising means for estimating remaining battery power based upon information from said means for comparing, said means for producing also indicating said estimated remaining battery power.

12. The apparatus in claim 10 wherein a microprocessor subsumes said motor drive circuitry and said means for comparing.

13. The apparatus in claim 11 wherein a microprocessor subsumes said motor drive circuitry and said means for comparing.

14. The apparatus in claim 10 wherein said scanning system is of the hand-held type.

15. The apparatus in claim 10 wherein said motor is of the three-phase, DC type.

16. The apparatus in claim 14 wherein a microprocessor subsumes said motor drive circuitry and said means for comparing.

17. The apparatus in claim 15 wherein a microprocessor subsumes said motor drive circuitry and said means for comparing.

* * * * *